US011479994B1

(12) United States Patent
Conley

(10) Patent No.: US 11,479,994 B1
(45) Date of Patent: Oct. 25, 2022

(54) SAFE RESTRAINT APPARATUS AND SYSTEM

(71) Applicant: James A Conley, Hickory Creek, TX (US)

(72) Inventor: James A Conley, Hickory Creek, TX (US)

( * ) Notice: Subject to any disclaimer, the term of this patent is extended or adjusted under 35 U.S.C. 154(b) by 791 days.

(21) Appl. No.: 16/184,055

(22) Filed: Nov. 8, 2018

(51) Int. Cl.
*E05B 75/00* (2006.01)

(52) U.S. Cl.
CPC ..... *E05B 75/00* (2013.01)

(58) Field of Classification Search
CPC ..... E05B 75/00; Y10T 70/404
See application file for complete search history.

(56) References Cited

U.S. PATENT DOCUMENTS 380,441 A * 4/1888 Hyatt et al. ..... E05B 75/00 70/16
1,047,457 A * 12/1912 Steimer ..... E05B 75/00 70/16
1,536,551 A * 5/1925 Young ..... A01K 15/04 119/819
3,621,681 A * 11/1971 Mikesic ..... A61F 5/3715 70/16
4,024,736 A * 5/1977 De Michieli ..... E05B 75/00 70/16
4,046,143 A * 9/1977 Bell ..... A61F 5/3715 128/882
4,237,708 A * 12/1980 Bremer, Jr. ..... E05B 75/00 128/882
4,860,560 A * 8/1989 Lundelius ..... A61F 5/37 70/16
5,092,592 A * 3/1992 FitzMaurice ..... A63B 69/0059 473/213
5,345,947 A * 9/1994 Fisher ..... A61F 5/3715 128/878
5,362,305 A * 11/1994 Varn ..... A61F 5/0193 128/882
5,363,679 A * 11/1994 Prasad ..... B60R 25/0225 70/209

(Continued)

OTHER PUBLICATIONS

Amazon (https://www.amazon.com/Spreader-Position-Master-restraintromance-Adjustable/dp/B076K31XR2) (Oct. 18, 2017).*

(Continued)

*Primary Examiner* — Kevin R Kruer
(74) *Attorney, Agent, or Firm* — Jeffrey Roddy

(57) ABSTRACT

A restraint apparatus and system includes a rigid bracelet cuff separator connected to and between a pair lockable bracelet cuffs. The bracelet cuff separator is width-adjustable and the bracelet cuffs are rotatable about a longitudinal axis of the bracelet separator. The system includes a leg restraint apparatus with a rigid separator connected to and between ankle cuffs. The ankle cuffs are joined distally to the rigid separator by multi-axis couplings that enable a restrained person to lift his or her feet a sufficient height in order to safely climb stairs or curbs. Sections of the bracelet separator and the leg restraint include portions configured to connect to a quick connect/disconnect coupling of a connector post. The handcuffing apparatus and the leg restraint apparatus may be employed separately of one another or independently of the connector post.

3 Claims, 14 Drawing Sheets

(56) References Cited

U.S. PATENT DOCUMENTS

| | | | | |
|---|---|---|---|---|
| 5,400,623 | A * | 3/1995 | Bota | E05B 75/00 128/869 |
| 5,542,433 | A * | 8/1996 | Saupe | A61F 5/3715 128/869 |
| 6,334,444 | B1 * | 1/2002 | Sisco | E05B 75/00 128/869 |
| 6,360,747 | B1 * | 3/2002 | Velarde | E05B 75/00 128/869 |
| 6,901,931 | B2 * | 6/2005 | Turesin | E05B 75/00 128/845 |
| 7,000,438 | B1 * | 2/2006 | Cooper | E05B 75/00 128/869 |
| 9,771,742 | B1 * | 9/2017 | Reed | B65H 75/4486 |
| 9,970,218 | B1 * | 5/2018 | Reed | B65H 75/4484 |
| 2006/0289017 | A1 * | 12/2006 | Schmeltz | A61F 5/3723 128/869 |
| 2009/0151401 | A1 * | 6/2009 | Phanstiel | A61F 5/3715 70/16 |
| 2011/0126597 | A1 * | 6/2011 | Irisawa | F41B 15/02 70/16 |
| 2012/0085135 | A1 * | 4/2012 | Louden | E05B 75/00 70/16 |
| 2014/0272858 | A1 * | 9/2014 | Fattori | A63B 69/18 434/253 |
| 2018/0279802 | A1 * | 10/2018 | Burnside | A61F 5/3715 |

OTHER PUBLICATIONS

Kink Industries (https://www.amazon.com/Kink-Industries-ST598-Steel-Spreader/dp/B003AY52YC) (first available Nov. 10, 2008).*

* cited by examiner

SAFE RESTRAINT APPARATUS AND SYSTEM

FIELD OF THE INVENTION

The present invention relates generally to restraint apparatus and systems, and more specifically to restraints employed by law enforcement for the transport of arrestees and other persons in custody.

BACKGROUND OF THE INVENTION

Restraint systems are long known in the art. In recent times, handcuffs used for restraining the hands typically possess a pair of lockable bracelets that are joined by a chain linkage, a rigid separator or a hinging linkage. Chain linkage typically permits a restrained person more freedom of movement than either a rigid separator or a hinging linkage. While handcuffs with chain linkage are relatively inexpensive and simple to use, information on various defeat methods has been widely disseminated. Accordingly, widespread use of chain linkage type handcuffs has led to serious injury to both law enforcement personnel and individuals in custody. Relative freedom of movement afforded by chain linkage type restraints may encourage an arrestee to fight with arresting officers or to attempt an ill advised escape. While most attempted escapes fail, both the arrestee and law enforcement personnel may be injured in the attempt. Moreover, because law enforcement is held liable for the safety of arrestees, the type of restraint selected for use must be appropriate for the particular transport situation and duration. Particularly combative arrestees may require restraints that provide less freedom of movement than chain linkage type restraints. Some past devices attempt to address this problem. Handcuff covers that convert the relatively flexible chain linkage of a pair of handcuffs into a rigid separator, may work well for the transport of previously subdued persons in controlled situations, but are not suitable for ad hoc "in field" responses to potentially combative persons. In the absence of appropriate restraint equipment, workarounds such as "hog-tying" sometimes employed to demobilize combative arrestees may result in serious injury or death of the arrestee. According to the Austin American Statesman, in nearly 300 Texas fatalities from 2005 to 2016, more than 50 people over the past decade have died at least in part due to law enforcement methods of forcible restraint or the physical stress associated with being taken into custody. Law enforcement personnel consistently cite combative or confrontational arrestees as a major challenge when making an arrest. Obviously, law enforcement personnel have a keen interest in keeping both themselves and arrestees safe.

What is needed is a safe restraint system that will reduce the risk of injury to both law enforcement personnel and arrestees; a restraint system that restricts unnecessary movement of an arrestee that might endanger law enforcement personnel, while permitting enough movement so the arrestee is not entirely incapacitated and is able to safely ambulate and enter and exit a vehicle, albeit slowly, with minimal assistance.

It would be desirable if the safe restraint apparatus and system were configured for rapid application.

It would be desirable if the safe restraint apparatus and system were to effectively restrict arrestee movement in order to discourage combativeness, without undue risk of injury to the arrestee such as difficulty in breathing, muscle damage, nerve damage or cardiac arrest.

It would be desirable if elements of the foregoing safe restraint apparatus and system were adjustable by law enforcement personnel when appropriate, to provide an arrestee or other restrained person with slightly more freedom of movement according to situational requirements which may include a need to reduce anxiety of the arrestee, or accommodate the limited range of movement of a previously injured, disabled, or older person.

It would be desirable if a handcuffing apparatus of the foregoing restraint system were to permit restraint of an arrestee's hands behind the arrestee with lowered risk of injury to the arrestee.

SUMMARY OF THE INVENTION

In accordance with various implementations described herein, a system of restraint includes a handcuffing apparatus, a leg restraint apparatus and a connector apparatus configured to connect the handcuffing apparatus with the leg restraint apparatus. In some implementations, advantageous features, objects and elements of the handcuffing apparatus permit its use separately of the leg restraint apparatus and connector apparatus.

In a general aspect of the present invention, a handcuffing apparatus includes a pair of lockable bracelet cuffs joined by a rigid bracelet cuff separator, the bracelet cuff separator including one or more slidable members that are selectively actuated in order to extend the width of the bracelet separator and thereby increase distance between the bracelet cuffs. A medial portion of the bracelet cuff separator is configured to connect to a distal end of an elongate connector post. The elongate connector post includes another distal end that is connectable to a leg restraint apparatus.

In another aspect of the present invention, combinable with any other aspect described herein, a rigid bracelet cuff separator has one or more members that longitudinally slide along a core member.

In another aspect of the present invention, combinable with any other aspect described herein, one or more slidable members of the bracelet cuff separator are joined to a swiveling cuff post that joins each slidable member to the corresponding bracelet cuff.

In another aspect of the present invention, combinable with any other aspect described herein, bracelet cuffs connected to slidable members of the bracelet cuff separator are axially rotatable.

In another aspect of the present invention, combinable with any other aspect described herein, bracelet cuffs connected to slidable members of the bracelet cuff separator may pivot or rock back and forth slightly, in a direction transverse the axial rotation.

In another aspect of the present invention, combinable with any other aspect described herein, slidable members of the bracelet cuff separator are lockable and releasable.

In another aspect of the present invention, combinable with any other aspect described herein, a releasable catch, latch or spring pin when actuated, permits one or more slidable members of the bracelet cuff separator to move outwardly or inwardly along a core member of the bracelet cuff separator.

In another aspect of the present invention, combinable with any other aspect described herein, a locking mechanism such as a releasable catch, latch or spring pin to secure one or more slidable members in a fixed position is inaccessible for a restrained person or requires a special purpose tool to actuate the locking mechanism.

In another aspect of the present invention, combinable with any other aspect described herein, a leg restraint apparatus may be linked to the handcuffing apparatus by way of a connector post.

In another aspect of the present invention, combinable with any other aspect described herein, the leg restraint apparatus includes a rigid separator, and the rigid separator includes opposing distal ends.

In another aspect of the present invention, combinable with any other aspect described herein, each opposing end of the leg restraint apparatus is connected to a lockable ankle cuff configured to fit around the ankle of a person.

In still another aspect of the present invention, combinable with any other aspect described herein, a multi-axis coupling such as a universal joint or a ball joint, and a control arm linkage may reside between each ankle cuff and a distal end of a rigid separator the leg restraint apparatus.

In another aspect of the present invention, combinable with any other aspect described herein, a connector post between the handcuffing apparatus and the rigid separator of the leg restraint apparatus may include a distal coupling that permits limited pivoting of the rigid separator relative to the connector post.

In another aspect of the present invention, combinable with any other aspect described herein, portions of the rigid separator of the leg restraint apparatus cooperate with a quick connect and quick disconnect coupling at an end of a connector post.

In another aspect of the present invention, combinable with any other aspect described herein, a connector post may include a distal coupler that permits limited pivoting of the bracelet separator of the handcuffing apparatus relative to the connector post.

In another aspect of the present invention, combinable with any other aspect described herein, one or more of the distal coupling members of a connector post configured to link the handcuffing apparatus to a leg restraint apparatus may include a ball type joint, or other suitable durable linkage as will suggest itself to those possessing skill in the art and access to this disclosure.

Although it is conceivable that in some implementations, chain linkage construction of suitable strength, e.g., ⅜ inch welded and tempered steel, may be employed as one element of a distal coupler of a connector post, it is intended that distal coupling members of the connector post permit only enough pivoting between connected elements of the restraint system to enable a restrained person to ambulate slowly without assistance and alternately raise their feet a height sufficient to navigate curbs or stair steps (e.g., 8 inches), and the like.

While a core member of a bracelet cuff separator depicted in various implementations herein is cylindrical, other shapes, e.g., rectangular solids may be suitable. Likewise, slidable members that are positionable along the core member may include a substantially cylindrical bore, or include other shapes and configurations to mate with and slide longitudinally along the core member. Mating surfaces between the core member and slidable members may include detents, grooves, ridges and other guiding elements such that the slidable members are prevented from axial rotation.

In some implementations, upper and lower quick connect/disconnect couplings may be configured to specifically couple to either the leg restraint apparatus or the handcuffing apparatus, or, the upper and lower couplings may be identical to aid in rapid deployment.

It will be appreciated by those having skill in the art that the overall size and dimensions of the handcuffing apparatus, the leg restraint apparatus and the connector post may vary.

The foregoing and other objects, features, and advantages of the invention will become more apparent from the following detailed description, which proceeds with reference to the accompanying figures wherein the scale depicted is approximate.

DETAILED DESCRIPTION OF THE INVENTION

Reference Listing of Elements

Figure 1:
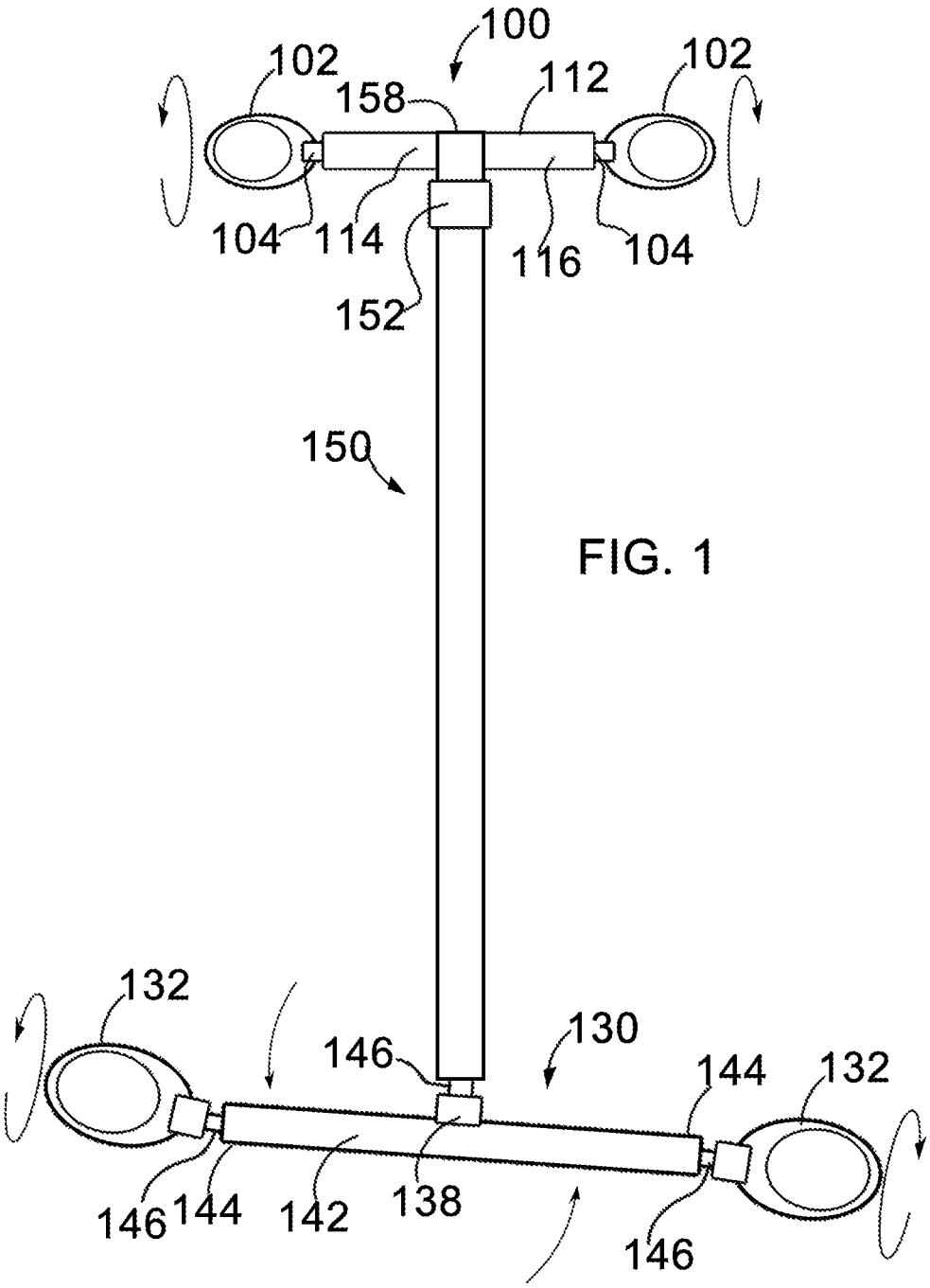
FIG. 1 depicts a generalized diagrammatic view of an implementation of a restraint system according to the present invention that includes a handcuffing apparatus, a leg restraint apparatus and a connector post capable of joining the handcuffing apparatus to the leg restraint apparatus.

Handcuffing apparatus 100
bracelet cuff 102 bracelet cuff post 104
cuff post slot 105
housing lock 108
guide post 110
aperture 111
bracelet cuff separator 112
slide guide 113
slidable member(s) 114, 116
housing lock guide 117
core member 118
recess 119*a*, 119*b*
aperture 121
leg restraint apparatus 130
ankle cuff 132
pivoting control arm 134
lock housing 138
rigid separator 142
distal end(s) separator 144, 145
multi-axis coupler 146
connector post 150
threaded connection 151
upper quick connect/disconnect coupler 152
lower quick connect/disconnect coupler 154
inner sleeve 155*a*
latch ball 155*b*
outer sleeve 155*c*
latch ball recesses 155*d*
male post 155*e*
locking sleeve 156
shackle 158
spacer 159
keyway 160, 161
notch 163

Definitions

Unless otherwise explained, any technical terms used herein have the same meaning as commonly understood by one of ordinary skill in the art to which this disclosure belongs. The singular terms "a", "an", and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. It should be understood that the objects, features and aspects of any embodiment disclosed herein may be combined with any object, feature or aspect of any other embodiment without departing from the scope of the invention. The term "comprises" means "includes." All publications, patent applications, patents, and other references mentioned herein are incorporated by reference in their entirety for all purposes. In case of conflict, the present specification, including explanations of terms, will control. In addition, the materials, methods, and examples are illustrative only and not intended to be limiting.

Figure 2:
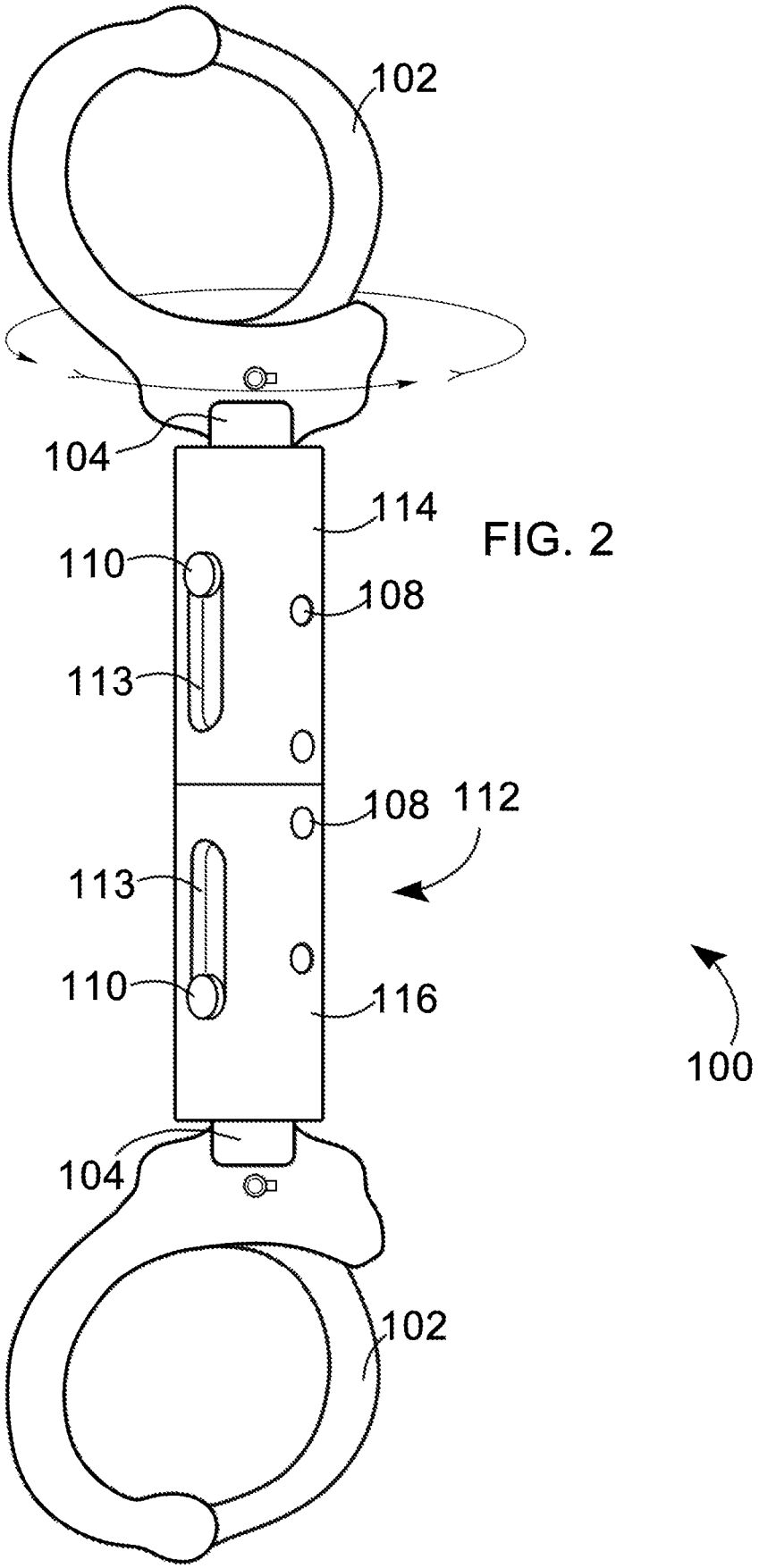
FIG. 2 is a side view of an example implementation of a handcuffing apparatus according to the present invention.
Figure 3:
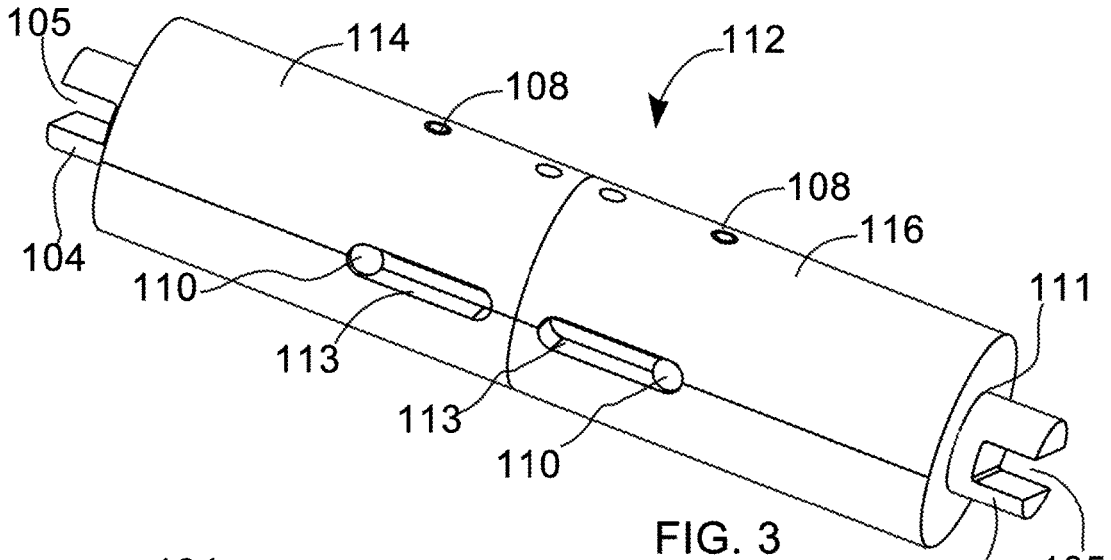
FIG. 3 is a side view of a bracelet cuff separator element of the handcuffing apparatus shown in (FIG. 2), with the bracelet cuffs removed, in a non-extended state.
Figure 4:
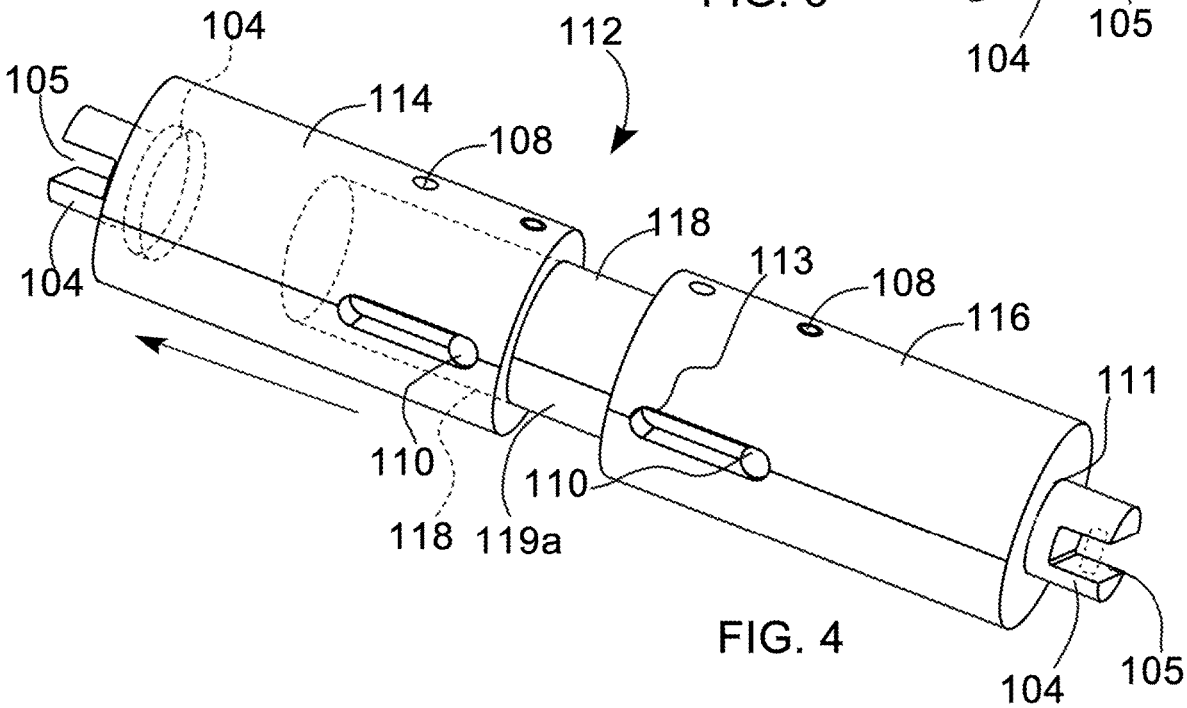
FIG. 4 is a side view of the bracelet cuff separator element shown in (FIG. 3) with one extended distal end.

Referring generally to FIGS. 1-12, a restraint apparatus and system includes at least a telescopable handcuffing apparatus 100. Handcuffing apparatus 100 includes a rigid bracelet cuff separator 112 connected to and disposed between a pair of bracelet cuffs 102 (shackle bracelets). Rigid bracelet cuff separator 112 includes a core member 118 and one or more slidable members 114, 116 mounted circumferentially to ends thereof. Each slidable member 114, 116 is connected to a cuff post 104 with a slotted portion 105 typically connected to a bracelet cuff 102 by a fastener, e.g., pin or post (FIG. 4). As shown in (FIG. 2), bracelet cuffs 102 are rotatable about a shared axis of the cuff posts 104. In some implementations the cuff posts 104 are configured to protrude from an aperture 111 at the ends of the slidable members and are at least swivelable within the apertures. Alternately, in some implementations, the cuff posts may be non-rotatatable relative to the slidable members and the bracelet cuffs may include a swivelable connection at a distal end of the cuff posts. Bracelet cuff separator 112 is width-adjustable by sliding the one or more slidable members 114, 116 along core member 118. Slidable members 114, 116 may be secured in a non-extended position or an extended position by actuating one or more housing locks 108. The one or more housing locks may include a catch, latch, recessed spring pin or other locking mechanism disposed between the slidable members and the core member 118 in a position inaccessible to a restrained person—or, the one or more housing locks 108 may require a special purpose tool (e.g., handcuff key) to release. In some implementations, slidable members 114, 116 may include a slide guide 113 that may be a slot through which guide post 110 fixed to core member 118, protrudes, in order to constrain the slidable members to non-rotational linear movement along the core member. The slidable members may include an exterior surface with one or more apertures, recesses, grooves or ridges adapted to mate with a quick connect/disconnect coupling member of a connector post 150 which may be placed over portions of the separator or inserted into the separator. Alternately, when at least one of the slidable members 114, 116 are secured in an extended position, effectively increasing the distance between the bracelet cuffs 102, a circumferential recess 119*a* is produced, exposing a surface of the core member 118 which may be configured to receive an upper quick connect/disconnect coupler 152 of a connector post 150. Connector post 150 also includes a lower coupler 154 configured to mate with portions of leg restraint apparatus 130. The lower coupler 154 may include a threaded connection as shown in (FIG. 9) or resemble a quick connect/disconnect coupler 154 shown in FIGS. 11 and 12. Similar to handcuffing apparatus 100, leg restraint apparatus 130 includes a pair of ankle cuffs 132 separated by rigid separator 142. One or more distal ends 144, 145 of the rigid separator 142 may include a multi-axis coupler 146 that may include a ball joint (b), a universal joint (u), or a multi-axis coupler with a control arm 134 that provides limited pivoting movement between the rigid separator 142 and the ankle cuffs 132.

In accordance with the present invention, FIG. 2 depicts a side view of an implementation of a handcuffing apparatus 100 where the bracelet cuffs 102 are rotatable about a shared axis of cuff posts 104. It should be noted that many traditional handcuffs possess cuff posts between connecting chain links and the lock assembly of the handcuffs. In traditional chain linked cuffs, the cuff post, sometimes called a "swivel," may include a distal knob portion retained by its neck by a restricted aperture on the lock assembly, permitting the cuffs to pivot relative to the links. It is intended that implementations herein may incorporate any aspect of the foregoing construction. It is not necessary that the cuff post itself be free at both ends. Accordingly, it is conceivable that a cuff post may be welded at one end or otherwise immovably joined to a slidable member 114, 116 as long as the bracelet cuffs 102 are rotatable with respect to the slidable members 114, 116.

In FIGS. 3-8 bracelet cuffs 102 shown in FIG. 2 are removed to better show the elements of the bracelet separator 112. In FIG. 3, slidable members 114, 116 are shown in a non-extended position. Note position of guide posts 110 that fixed to the core member 118 and constrained to travel linearly within slots 113 of the slidable members 114, 116.

In FIG. 4, slidable member 116 is shown extended and cuff post 104 protruding through aperture 111 travels with the slidable member. In some implementations, cuff posts 104 include a distal slot 105 configured for engagement with portions of a bracelet cuff. The particular mechanical engagement with the bracelet cuff may be a pin (see dashed line pin) transversely fixed in slots 105, or any another suitable attachment; e.g., post, threaded fastener, knob, stud, rivet, etc., that will be appreciated by those having skill in the art and access to this disclosure. For example, cuff posts may include a central aperture configured to receive portions of a bracelet cuff locking assembly.

Figure 5:
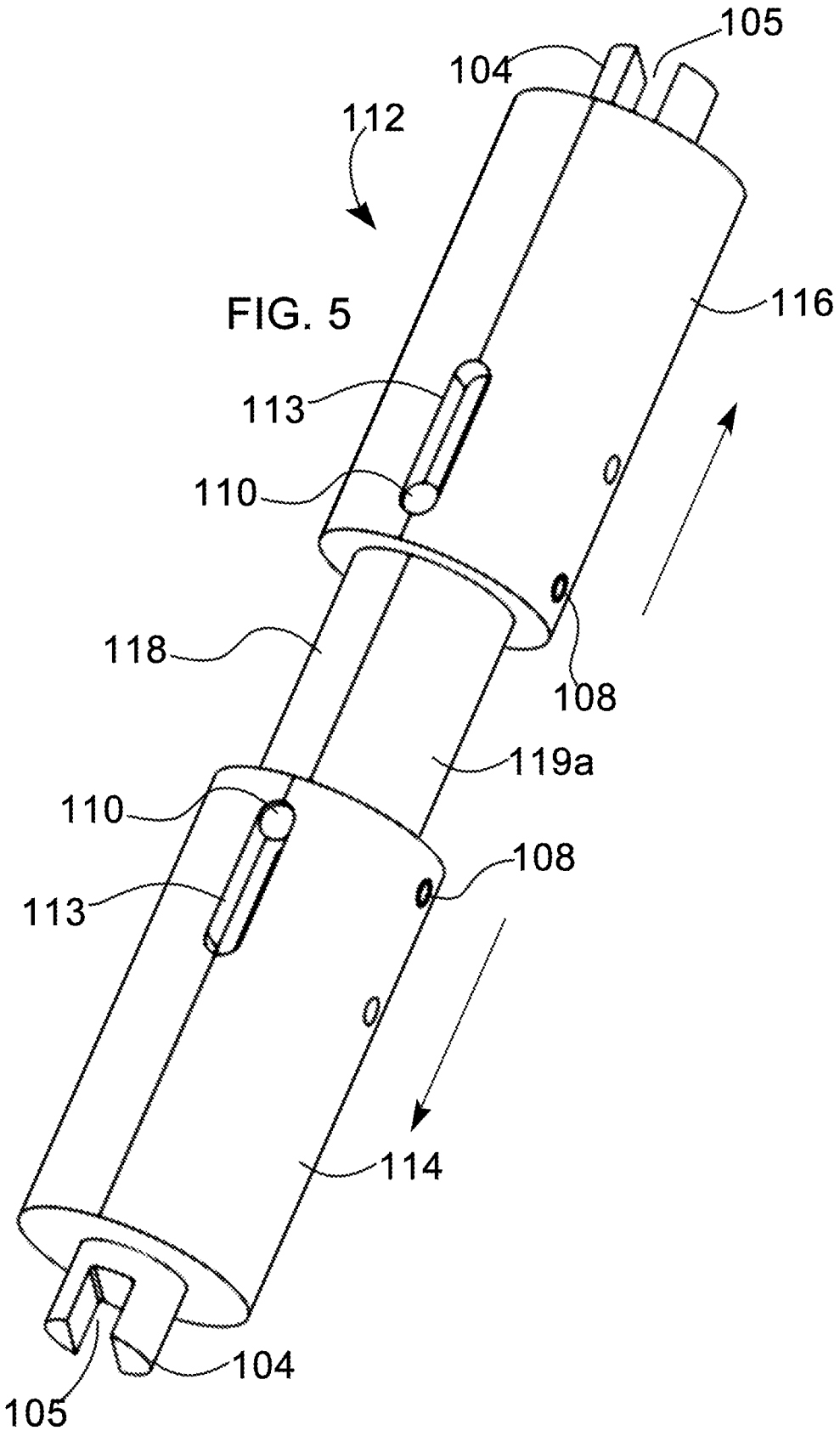
FIG. 5 is a side view of the bracelet cuff separator element shown in (FIG. 3) with two extended distal ends.

Moving to FIG. 5, bracelet cuff separator 112 is shown with both slidable members 114, 116 extended. While implementations illustrated herein show two members capable of slidable movement, it is possible that certain implementations include only one slidable member configured for back and forth movement. In any case, extending one or more of the slidable members 114, 116 produces a recess 119*a* having sides comprised of one or more of the slidable members 114, 116 and a bottom that includes a surface of core member 118.

Figure 6:
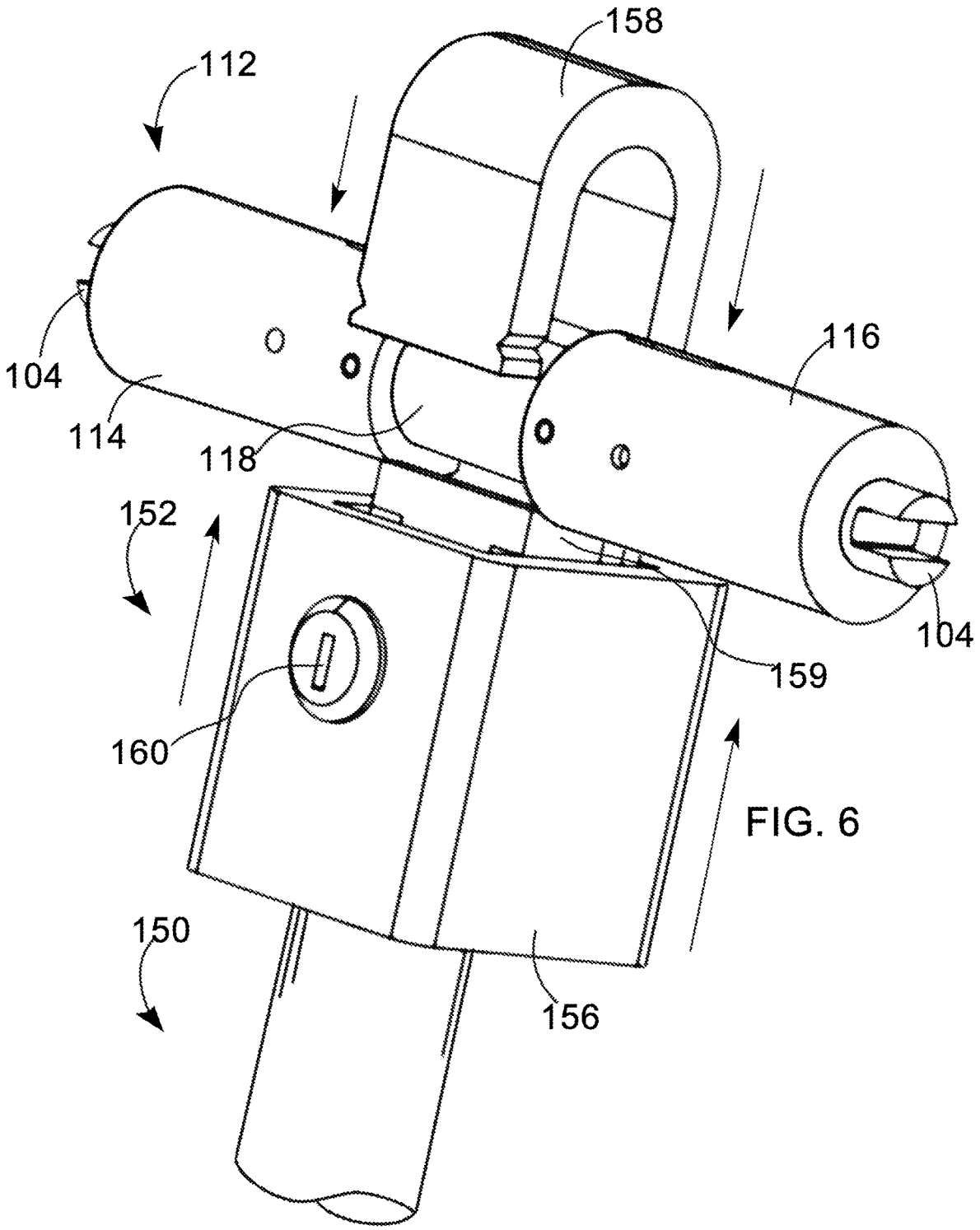
FIG. 6 is a perspective view showing an end of the connector post 150 shown in (FIG. 1) with an upper quick connect/disconnect coupler 152 engageable with the handcuffing apparatus 100 in a position just prior to attachment.
Figure 7:
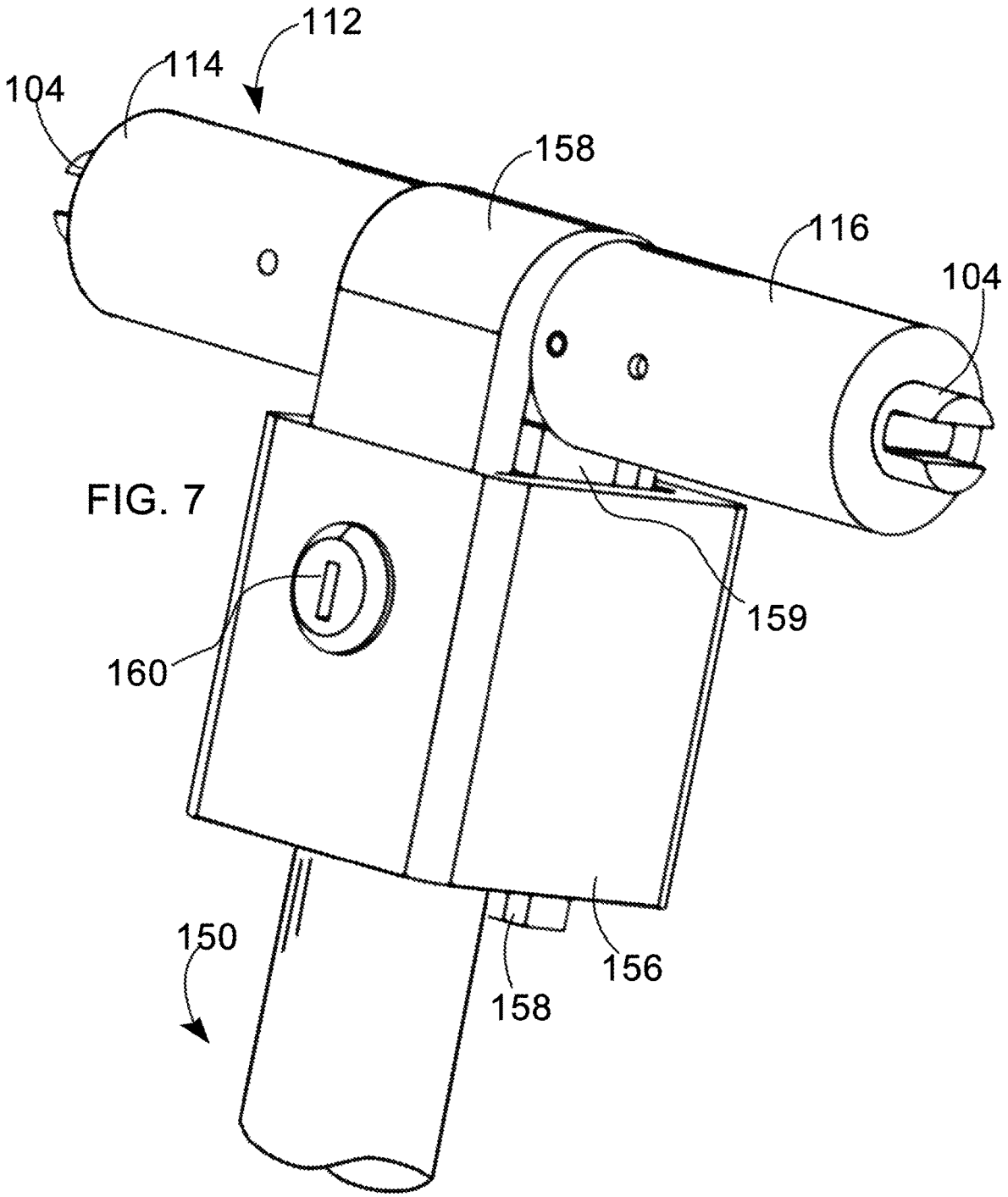
FIG. 7 is a perspective view showing an end of the connector post 150 of (FIG. 6) with quick connect coupling 152 secured to the handcuffing apparatus 100.

Moving to FIG. 6, the recess 119*a* of bracelet separator 112 may be sized and shaped to accommodate upper quick connect/disconnect coupling 152 of connector post 150. Quick connect/disconnect coupling 152 may include portions; e.g., a bracket, configured to engage with the recess. For purposes of this disclosure, the term "bracket" may include a generally u-shaped shackle 158 such as that found on keyed padlocks and portions of the shackle may resemble a broad vaulted section instead of the curved cylindrical post of common padlocks. In such cases, the width of the shackle is closely matched with the width of recess 119*a* so the former may enter smoothly and nest firmly in the later, without undue play. Shackle portion 158 may be fixed to the connector post 150 by any suitable means; e.g., welding, and locking sleeve 156 may be slidably disposed around connector post 150 and configured to slide up and down the connector post and portions of the shackle in order to close and open the gap between the shackle and the locking sleeve similar to a receiver lock. Shackle 158 has been placed over recess 119*a* of the bracelet separator 112 and is ready to engage with the slidable locking sleeve 156 which may include a lower spacer 159 configured to firmly abut an underside of the core member when the locking sleeve 156 is engaged with the shackle (FIG. 7). It is intended that when the locking sleeve fully engages with the locking end of the shackle which may have detents (d) similar to a padlock shackle, the sleeve and shackle are effectively locked and must be unlocked by tool/key insertion into keyway 160 as shown, or other suitable shackle releasing mechanism; e.g., latch, catch, push pin, spring pin, etc., in a location selected for its inaccessibility to a handcuffed person. Various common lock release mechanisms are known in the art and it is intended that any suitable lock release may be used as long as the release requires a special tool such as a key to operate, or, the release is disposed on the apparatus in a location that renders it inoperable by a restrained person.

In a manner similar to the lower quick connect/disconnect coupling 154 shown in FIGS. 11 and 12, it is conceivable that a multi-axis coupler 146 which may include a ball joint (b) portion (FIG. 11), a universal joint (u) portion (FIG. 12) or other linkage to permit limited pivoting movement of the bracelet separator 112 relative to connector post 150 may reside below the upper quick connect/disconnect coupling 152 on the connector post. Alternately, the upper end of the connector post may lack any multi-axis coupler and thereby maintain bracelet separator 112 and connector post 150 in a fixed disposition; e.g., rigid T-configuration, when coupled.

Figure 8:
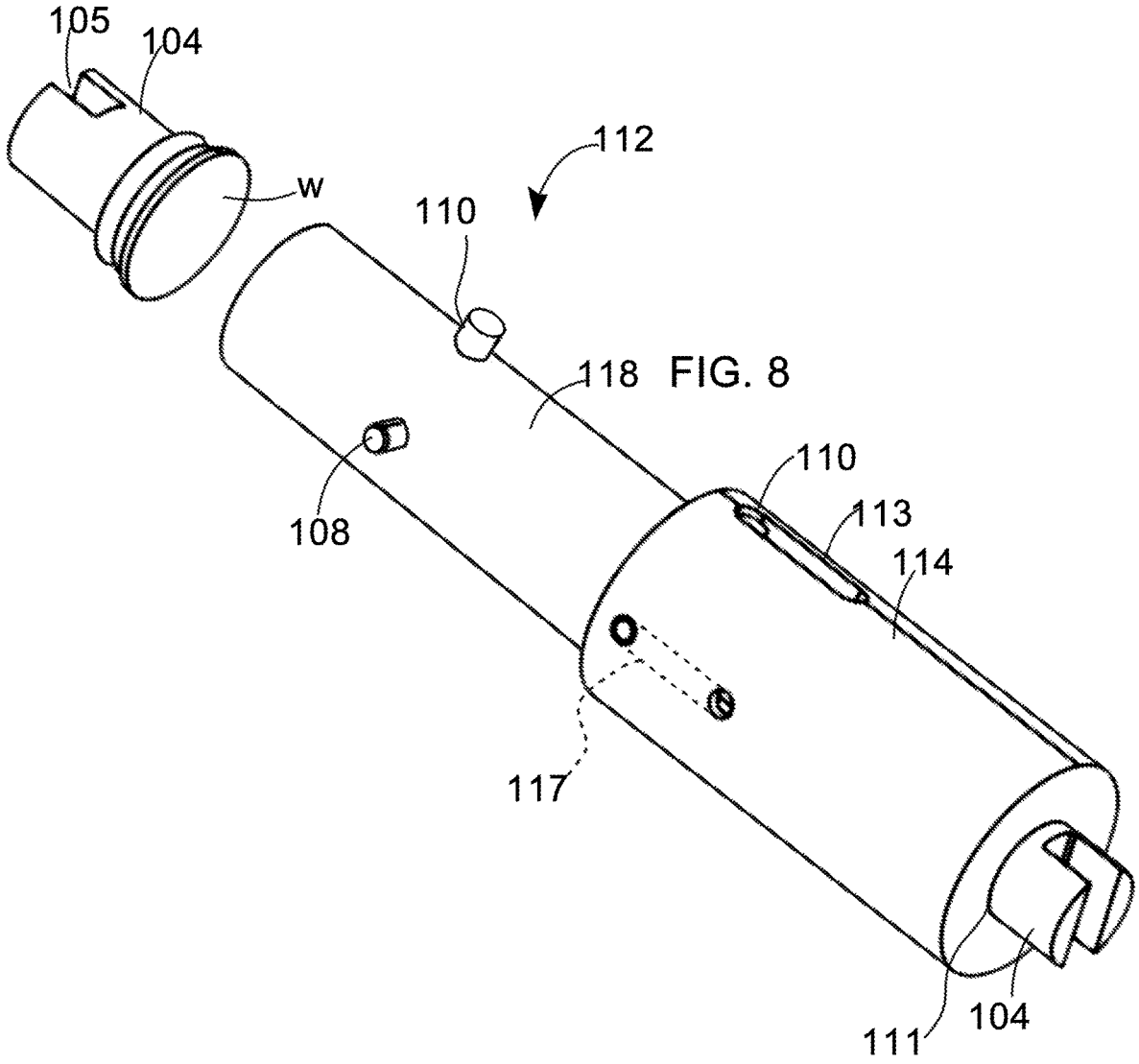
FIG. 8 is a partial exploded view of an example implementation of the bracelet cuff separator with one of two telescopable slidable members removed to display inner elements.

FIG. 8 is a partial exploded view of a bracelet separator 112 with slidable member 116 removed to expose core member 118, housing lock 108, cuff post 104 and guide post 110. Slidable members 114, 116 are generally barrel shaped, include a bore for the reception of core member 118 and a reduced aperture 111 at opposite ends. Typically, the slidable members are repositionable from a non-extended position to an extended position by pressing housing lock 108 which may be a spring pin nested within one of two in-line apertures of each slidable member. In order to actuate a slidable member, a rounded head of the housing lock may be accessed (pressed) with a pointed tool like that commonly found on a cuff key. When pressed, lock 108 disengages with a first aperture and is prompted to travel within interior machined slot 117 to a second in-line aperture for engagement therein. Cuff posts 104 are positioned distally relative to disk (w) which may be washer adapted to fit in a machined circumferential groove on an inner surface of the slidable member and provide a bearing surface for a proximal, non-exposed end of the cuff post. Other methods of retention between the slidable members and the cuff posts such as prongs, detents, lips or ridges on the inside surfaces of the slidable members will be appreciated by those having skill in the art and access to this disclosure.

Figure 9:
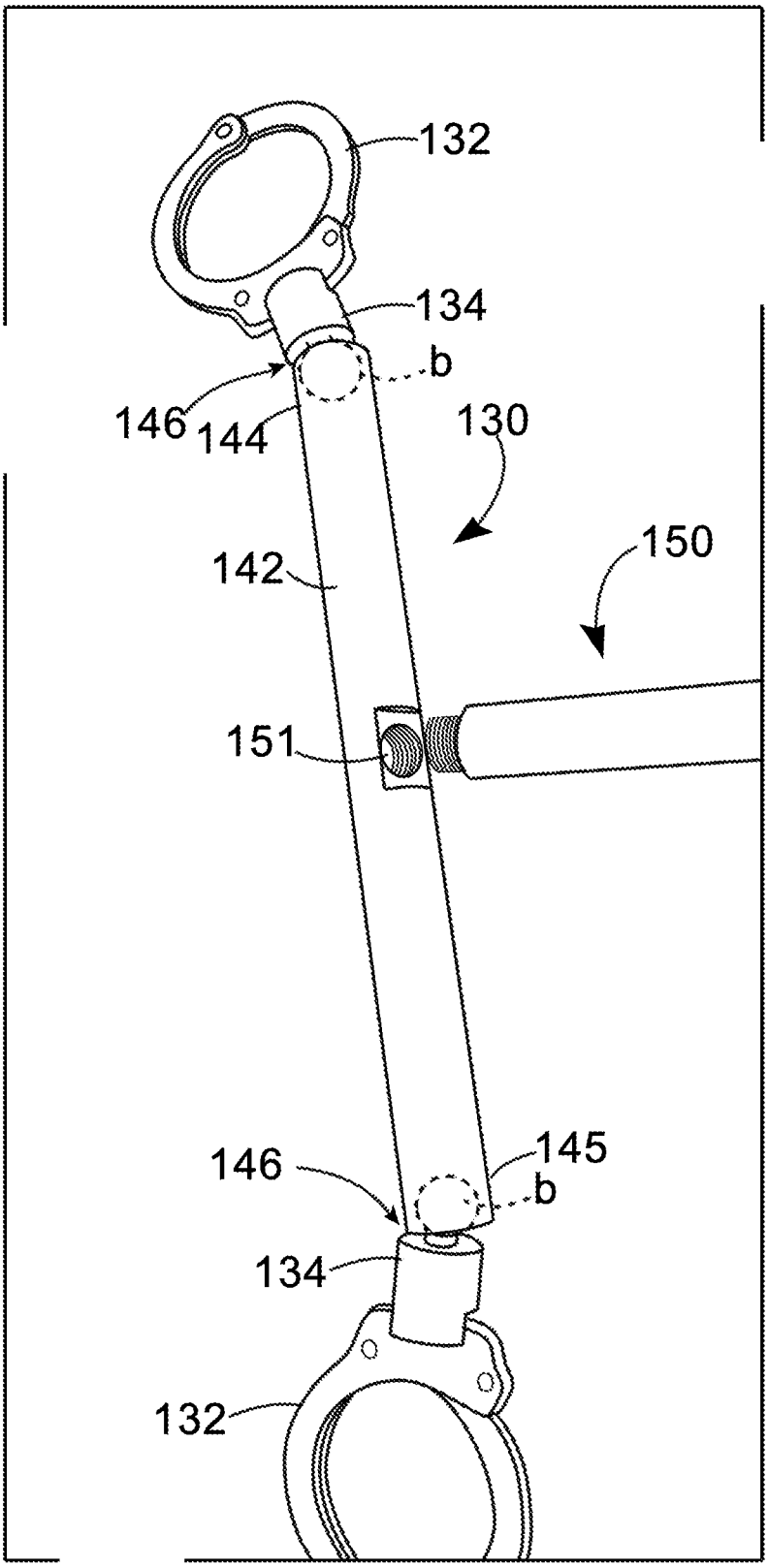
FIG. 9 is an example implementation of a leg restraint apparatus 130 that includes a rigid separator 142 with threaded connection 151 configured to receive a threaded end of a connector post 150.

FIG. 9 is a partial perspective view of an example implementation of a leg restraint apparatus 130 that may be linked to the handcuffing apparatus by connector post 150. Leg restraint apparatus 130 includes a pair of ankle cuffs 132 that are pivotably connected at distal ends 144, 145 of rigid separator 142 similar to the bracelet cuffs 102 of handcuffing apparatus 100. In some implementations, connector post 150 is connectable to the rigid separator 142 with a threaded connection 151. It should the understood that owing to the general mechanical similarities of the handcuffing apparatus and the leg restraint, it is conceivable that the distal ends of the leg restraint be likewise adapted for telescopable extension.

Figure 10:
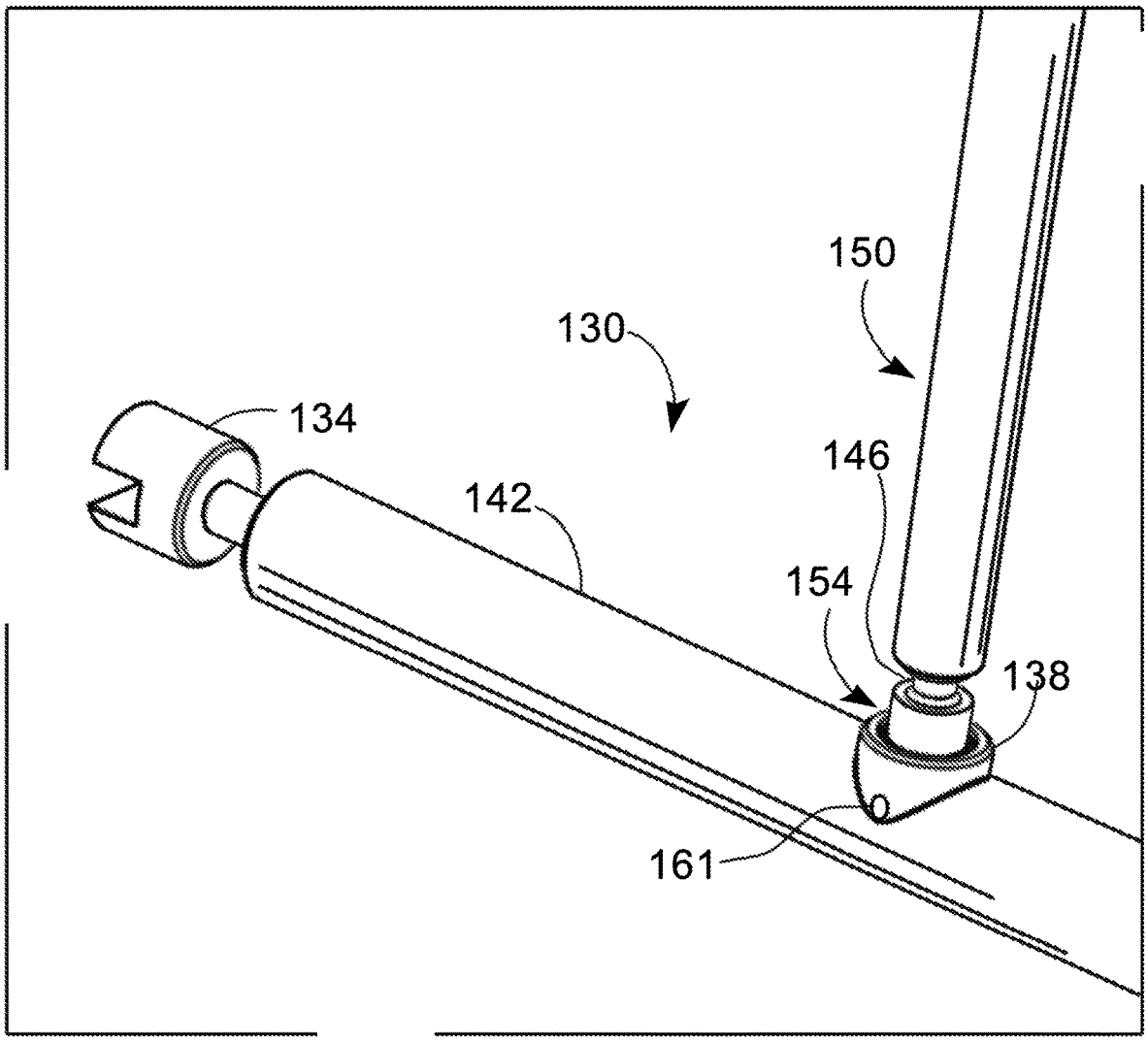
FIG. 10 is another example implementation of a leg restraint apparatus 130 that includes a lower quick connect/disconnect coupler 154 configured to receive a distal end of a connector post.

FIG. 10 is a partial perspective view of another example implementation of leg restraint apparatus 130 which includes a pair of ankle cuffs 132 that are separated by a rigid separator 142 similar to bracelet separator 112 of handcuffing apparatus 100. In the implementation depicted, connector post 150 is connectable to the rigid separator by quick connect/disconnect coupling 154 which is mechanically similar to an air hose connector or hydraulic quick connector and which typically includes a female portion (see FIG. 11) with coaxially joined inner 155*a* and outer sleeves 155*c*, but requiring no fluid channel or valve. Disposed inside the inner sleeve 155*a* are latch balls 155*b* which are engageable and disengageable within latch ball recesses 155*d* by sliding the outer sleeve coaxially up or down. The female portion is configured to mate with a male post 155*e* that includes a circumferential plug boss and a circumferential ball groove. Unlocking is accomplished by pulling the outer sleeve coaxially away from the inner sleeve which disengages the latch balls from the ball groove. In the example shown, a medially located generally cup shaped lock housing 138 of the rigid connector 142 encircles the male post 155*e*. When the female 155*a*-155*d* and male parts 155*e* are engaged, the top edge of the outer sleeve 155*c* is recessed below the upper edge of the lock housing. The inside diameter of the lock housing 138 is configured to very closely surround the recessed outer sleeve. Accordingly, once engaged, the outer sleeve 155*c* is rendered inaccessible, and sliding coaxial disengagement is not possible without a special tool. In the example shown, a small keyway 161 below the lock housing exits interiorly just beneath the lower edge of the outer sleeve and allows law enforcement personnel to insert a narrow tool or key into a notch or aperture 163 on the outer sleeve 155*c* to displace outer sleeve 155*c* relative to inner sleeve 155*a* and thereby disengage the quick connect/disconnect coupler 154.

Figure 11:
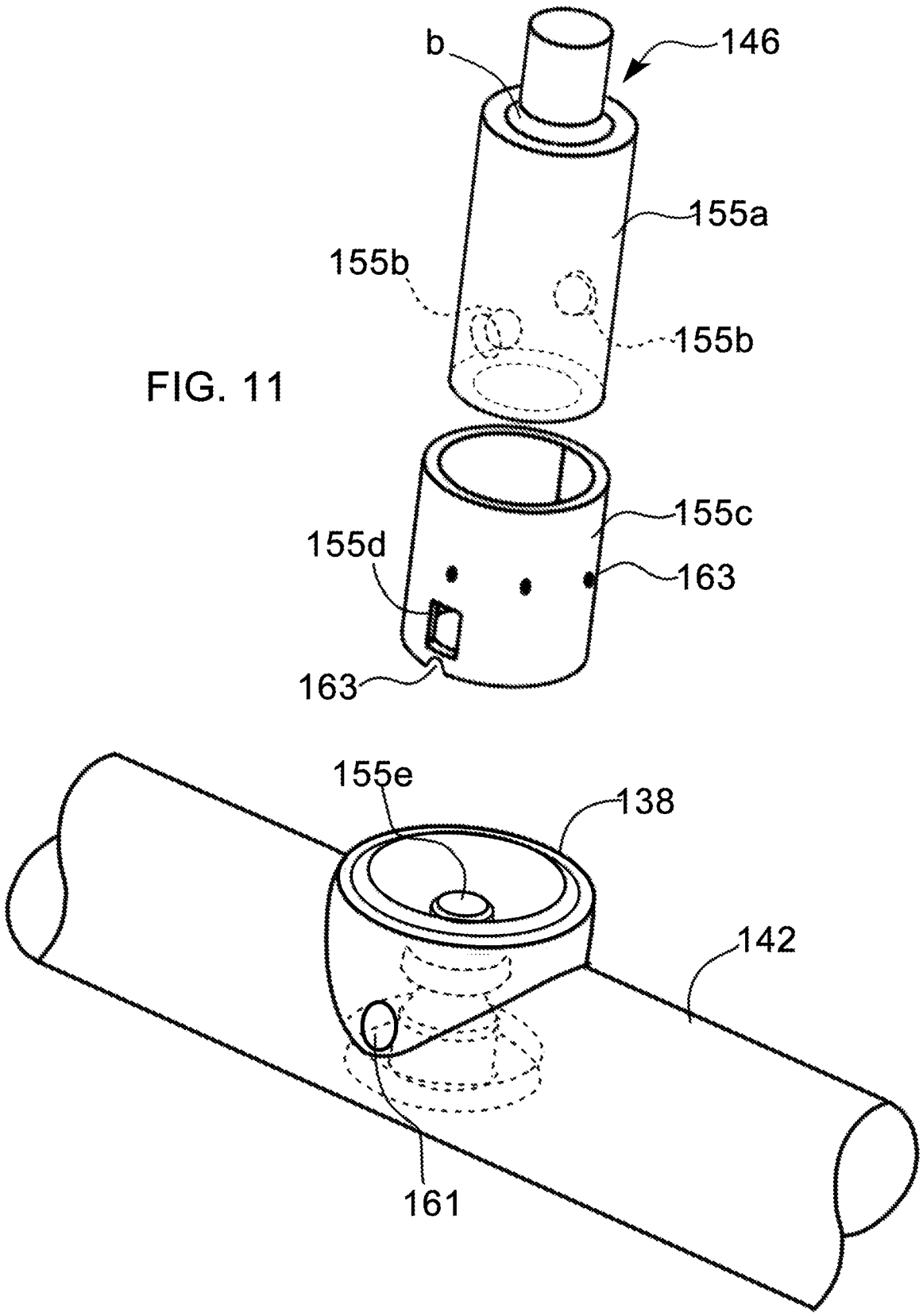
FIG. 11 is a partial exploded view of the quick connect/disconnect coupler shown in (FIG. 10) with a ball joint (b) type multi-axis coupler portion.
Figure 12:
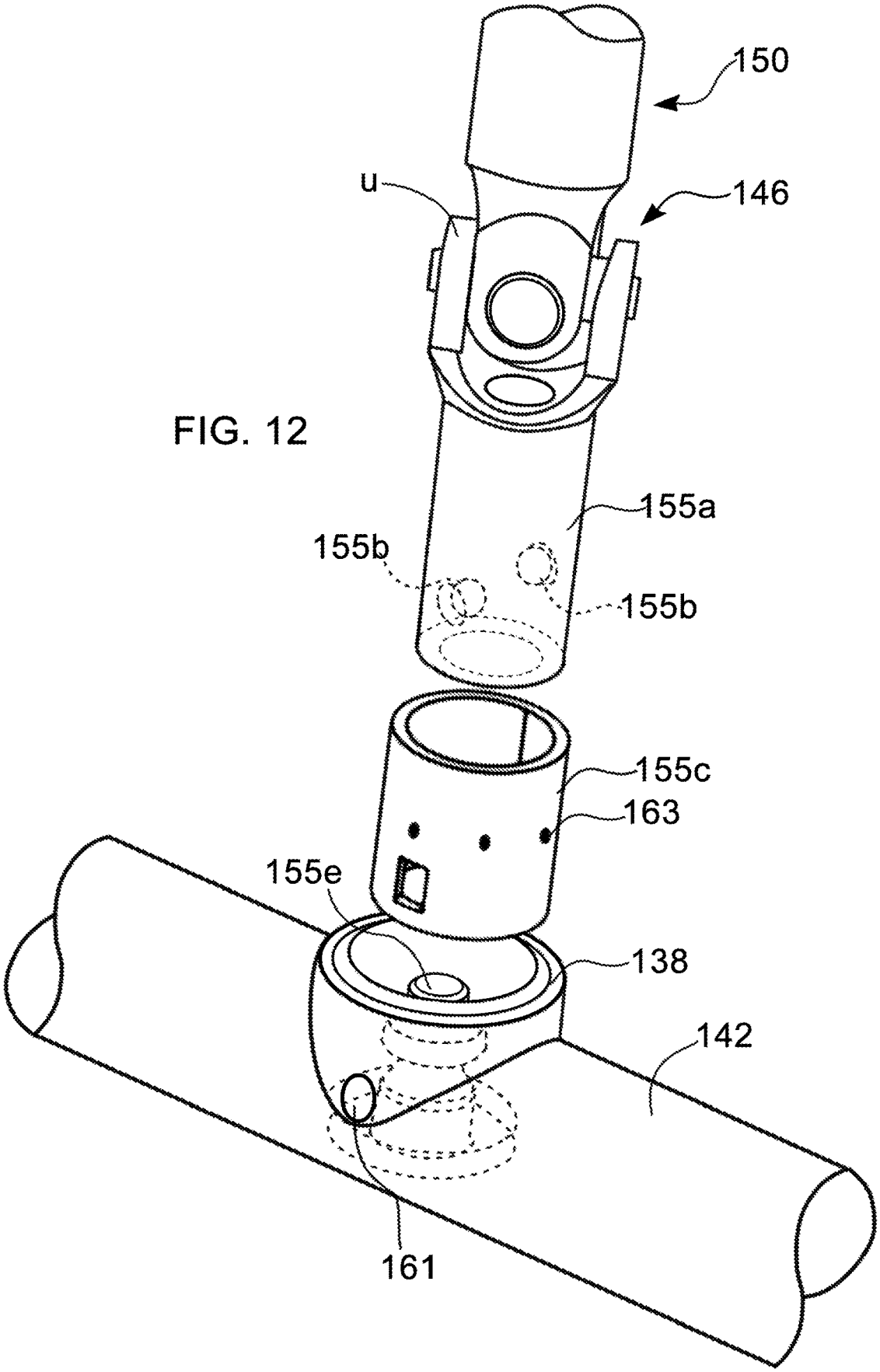
FIG. 12 is a partial exploded view of the quick connect/disconnect coupler that includes a universal joint (u) multi-axis coupler portion.

FIG. 11 is a partial exploded view showing a midsection of the lower quick connect/disconnect coupler 154. A multi-axis coupler 146 may reside between upper coupler 154 and connector post 150 to permit the rigid separator 142 to pivot slightly to assist a restrained person with ambulation, especially when traversing curbs, climbing steps or entering a vehicle. Multi-axis coupler 146 may be a ball joint (b) type multi-axis coupler, a universal type (u) coupler as shown in FIG. 12, or any other suitable multi-axis coupler that may include a control arm as would be appreciated by those having skill in the art and access to this disclosure.

Figure 13:
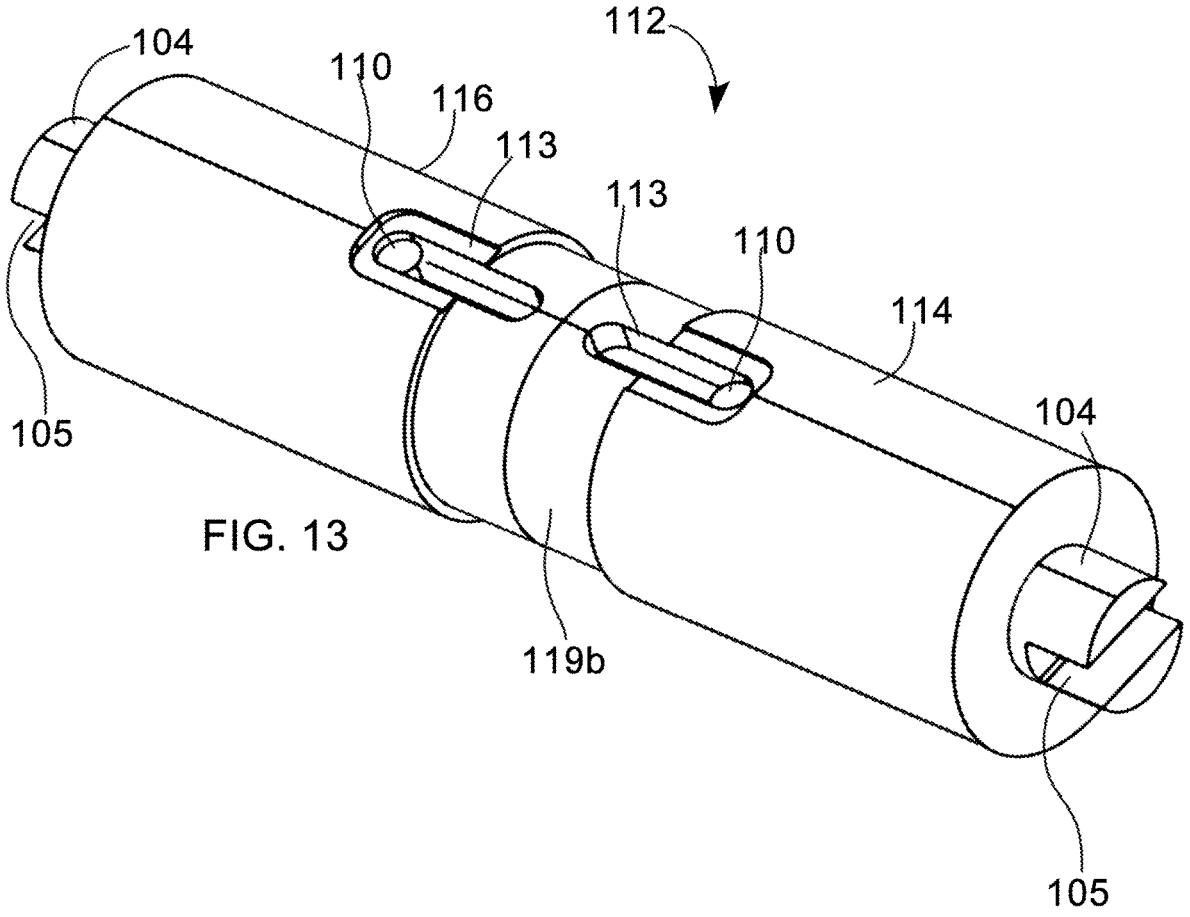
FIG. 13 is a perspective view showing another embodiment of a bracelet cuff separator 112 with an external catch **119*b* adapted to receive portions of an upper quick connect/disconnect coupler 152**.
Figure 14:
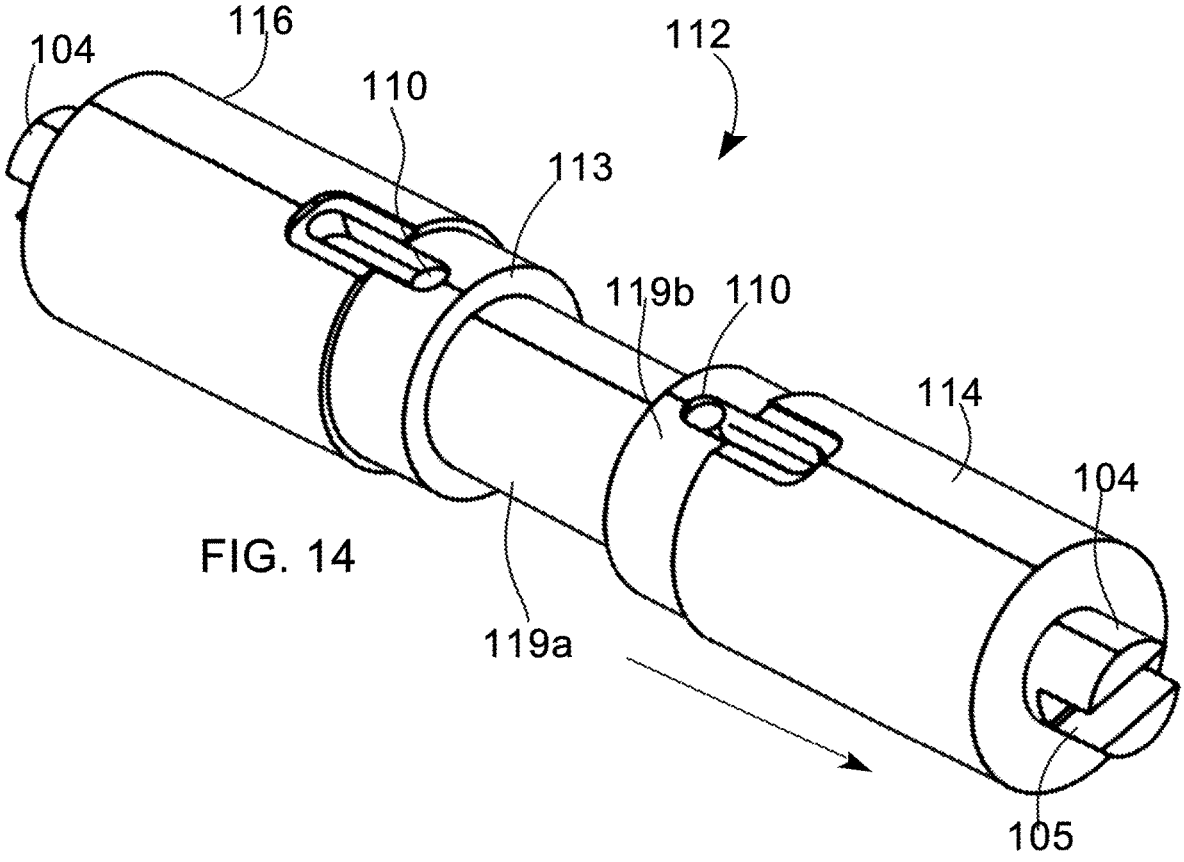
FIG. 14 is a perspective view of the embodiment shown in (FIG. 13) in an extended position to reveal recess **119*a* which is likewise adapted to receive portions of an upper quick connect/disconnect coupler 152**.

FIG. 13 is a perspective view of a bracelet cuff separator similar to the implementation shown in (FIGS. 3-5). In this implementation, an exterior surface of the bracelet separator includes an outer recess 119*b* adapted to receive a wrap-around/over locking element; e.g., FIG. 6. In FIG. 14, the slidable members 114, 116 of the bracelet cuff separator 112 of FIG. 13 are shown in an extended state which produces second recess 119*a*. It is intended that the various objects, features and aspects of any handcuffing implementation described herein may be combined with objects and features of any other handcuffing implementation described herein.

Figure 15:
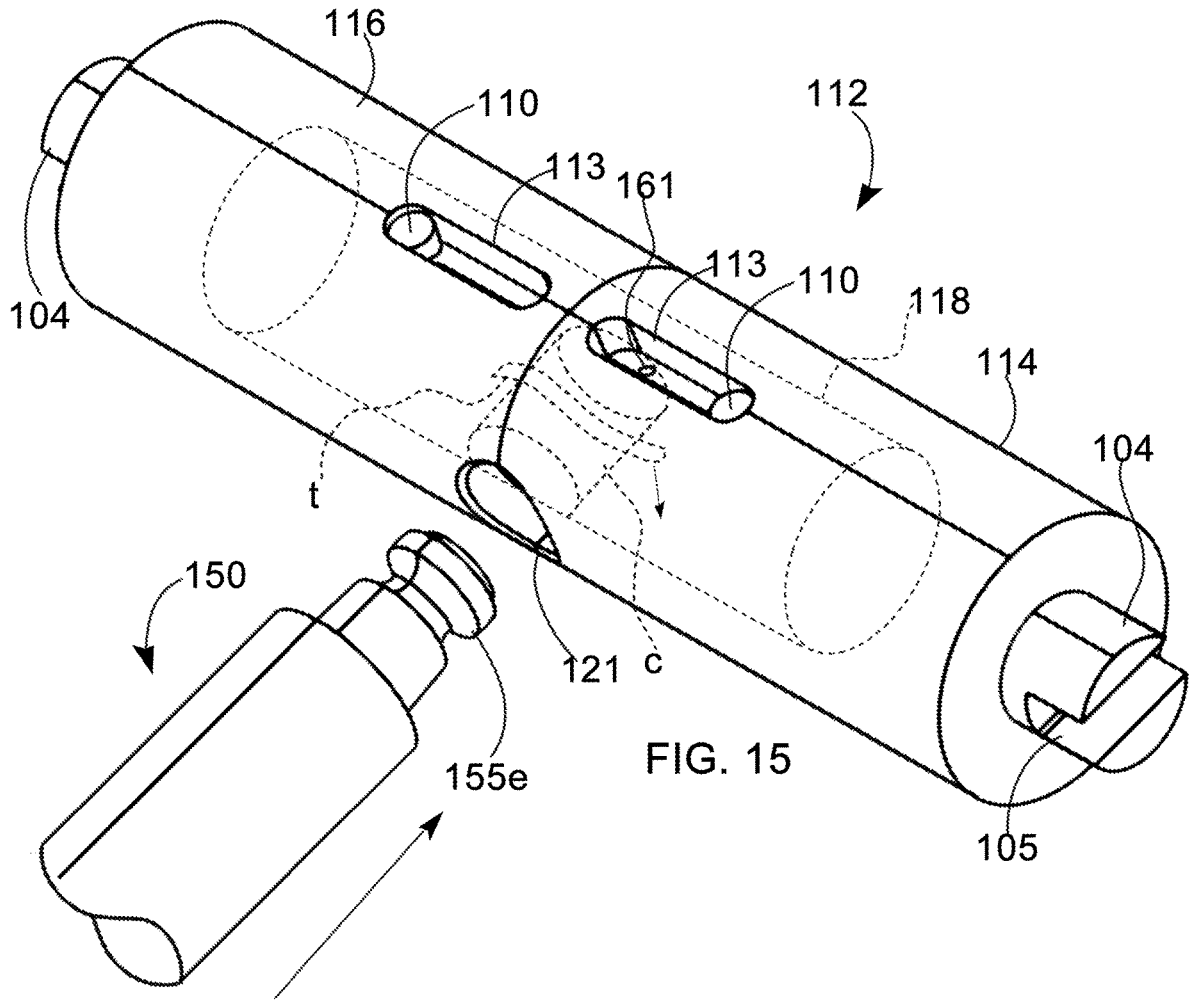
FIG. 15 is a perspective view showing another embodiment of a bracelet cuff separator 112 with an aperture 121 and channel (c) adapted to receive a male portion **155*e* of a connector post 150**.

FIG. 15 is a perspective view of another bracelet separator element with slidable members 114, 116. Aperture 121 which may be medial and divided by the slidable members 114, 116 is configured to receive a male post 155*e* of connector post 150 which may be inserted into channel (c) and engaged with the core portion 118 illustrated diagrammatically in dashed line. The bracelet separator may include a small aperture 161, a keyway 160 or other entry point for the insertion of an unlocking tool that will disengage the male post and the bracelet separator element. Persons having skill in the art and access to this disclosure will appreciate that various receiver type locking mechanisms may be used to engage with insertable post 155*e*. Typically receiver locks include an aperture 121, a channel (c) and a transversely disposed tab (t) that is configured to slip over the head of male portion 155*e* and snap into the circumferential waist of 155*e*. Connector post 150 cannot be pulled free once engaged with tab (t), which must be disengaged by a key or other unlocking tool inserted through a key way 161 or other passage. Tab (t) is illustrated diagrammatically and may be a flat spring tab, a spring actuated cylindrical post, a curved prong or any other portion adapted to snap into place and lockably engage male portion 155*e* when inserted into channel (c) via aperture 121. Generally, such a key way 161 may be placed anywhere on the separator, but preferably in a position easily accessible by law enforcement personnel, yet inaccessible to a restrained person.

It should be understood that the drawings and detailed description herein are to be regarded in an illustrative rather than a restrictive manner, and are not intended to be limiting to the particular forms and examples disclosed. Accordingly, it is intended that this disclosure encompass any further modifications, changes, rearrangements, substitutions, alternatives, design choices, and embodiments as would be appreciated by those of ordinary skill in the art having benefit of this disclosure, and falling within the spirit and scope of the following claims.

What is claimed is:

1. A restraint apparatus comprising:

a rigid separator including a core member and a pair of distal ends surrounding the core member, each distal end includes a bracelet cuff post connected to a bracelet cuff such that a distance between the bracelet cuff and the distal end it is connected to is fixed; and, at least one of the distal ends is configured to selectively longitudinally slide relative to the core member, the core member includes a longitudinal axis and each bracelet cuff post is constrained to coaxial rotation relative to the longitudinal axis of the core member;

the rigid separator includes a circumferential recess formed by exposure of the core member when the one or more distal ends are slidably moved apart, the circumferential recess is configured to receive a quick connect/disconnect coupling of a connector post.

2. The restraint apparatus according to claim 1 further comprising the one or more distal ends are releasable and securable relative to the core member of the rigid separator, via one or more catch members, and slidable movement of each of the distal ends is constrained by a slide guide.

3. The restraint apparatus according to claim 1 further comprising a housing lock configured to secure in position or release the one or more distal ends for slidable movement.

* * * * *